US006217710B1

(12) United States Patent
Scherz et al.

(10) Patent No.: US 6,217,710 B1
(45) Date of Patent: Apr. 17, 2001

(54) PROCESS FOR REGULATING A SCREW PRESS

(75) Inventors: Manfred Scherz, Voitsberg; Walter Cadek, Graz, both of (AT)

(73) Assignee: Andritz-Patentverwaltungs-Gesellschaft m.b.H., Graz (AT)

( * ) Notice: Subject to any disclaimer, the term of this patent is extended or adjusted under 35 U.S.C. 154(b) by 0 days.

(21) Appl. No.: 09/248,331

(22) Filed: Feb. 10, 1999

(30) Foreign Application Priority Data

Feb. 10, 1998 (AT) ..... 241/98

(51) Int. Cl.[7] ..... D21F 11/00

(52) U.S. Cl. ..... 162/198; 162/198; 162/252; 162/254; 162/262; 162/263; 162/264; 162/DIG. 10; 100/110-117; 100/145-150

(58) Field of Search ..... 162/198, 252, 162/254, 262–4, DIG. 10; 100/110–17, 145–50

(56) References Cited

U.S. PATENT DOCUMENTS 3,548,743 * 12/1970 Pikel ..... 100/145
3,938,434 * 2/1976 Cox ..... 100/117
4,041,854 * 8/1977 Cox ..... 100/112

* cited by examiner

*Primary Examiner*—Stanley S. Silverman
*Assistant Examiner*—Mark Halpern
(74) *Attorney, Agent, or Firm*—Alix, Yale & Ristas, LLP

(57) ABSTRACT

The invention refers to a process for regulating a screw press, particularly for dewatering a pulp suspension. It is mainly characterized by the speed being varied as a function of the torque.

10 Claims, 4 Drawing Sheets

PROCESS FOR REGULATING A SCREW PRESS

BACKGROUND OF THE INVENTION

The invention relates to a process for regulating a screw press, particularly for dewatering a pulp suspension.

In current screw presses, the level is measured in the feed box. If the level rises, either the screw press speed is increased or the infeed of suspension to be dewatered is reduced. This is primarily the case in sludge dewatering presses because they have very long retention times and any change in the filling level does not have any effect until after this retention period, which is in the range of 20 minutes.

In pulp screw presses, a torque controller is normally used. This keeps the torque at a constant level regardless of speed and throughput. On the other hand, the regulating efficiency is relatively poor, as is then reflected in the power consumption by the subsequent mixer. The reason for substantial fluctuations in the power consumption is the varying outlet dry content, which is lower at high speed and higher at low speed.

SUMMARY OF THE INVENTION

The aim of the invention is always to obtain a constant final dry content, also at fluctuating feed conditions. In addition, the invention should provide constant operating conditions without any build-up of operating parameters.

The invention is thus characterised by the speed being varied as a function of the torque, where the regulating process can be applied according to a torque characteristic curve. This ensures that the dry profile of the pulp suspension remains even along the screw axle, even at different production rates.

A favourable further development of the invention is characterised by the nominal speed being increased when the torque rises. If the amount of pulp fed to the press increases, the screw has a higher filling level and the torque increases. The result would be a higher outlet concentration. By raising the nominal speed of the press, the filling level drops accordingly and the outlet concentration remains constant.

A favourable configuration of the invention is characterised by the speed being maintained at a constant level if the torque changes within a pre-set range. As a result, any build-up of operating parameters as a result of the regulating process can be prevented.

An advantageous configuration of the invention is characterised by the counter-pressure being reduced if the torque is rising. This means that constant operations can be achieved quickly, particularly in the starting phase.

An advantageous further development of the invention is characterised by the torque being varied in the range of 1 to 6, preferably 1 to 3. The regulating process is particularly stable within this torque range.

A favourable further development of the invention is characterised by the speed being varied in the range of 1 to 4, preferably 1 to 2.5. As a result, a constant regulating process can be achieved even if production fluctuates erratically, which means that the power consumption by a subsequent mixer is also very constant.

BRIEF DESCRIPTION OF THE DRAWINGS

The invention will now be described in examples and referring to the drawings, where.

DETAILED DESCRIPTION OF THE PREFERRED EMBODIMENT

Figure 1:
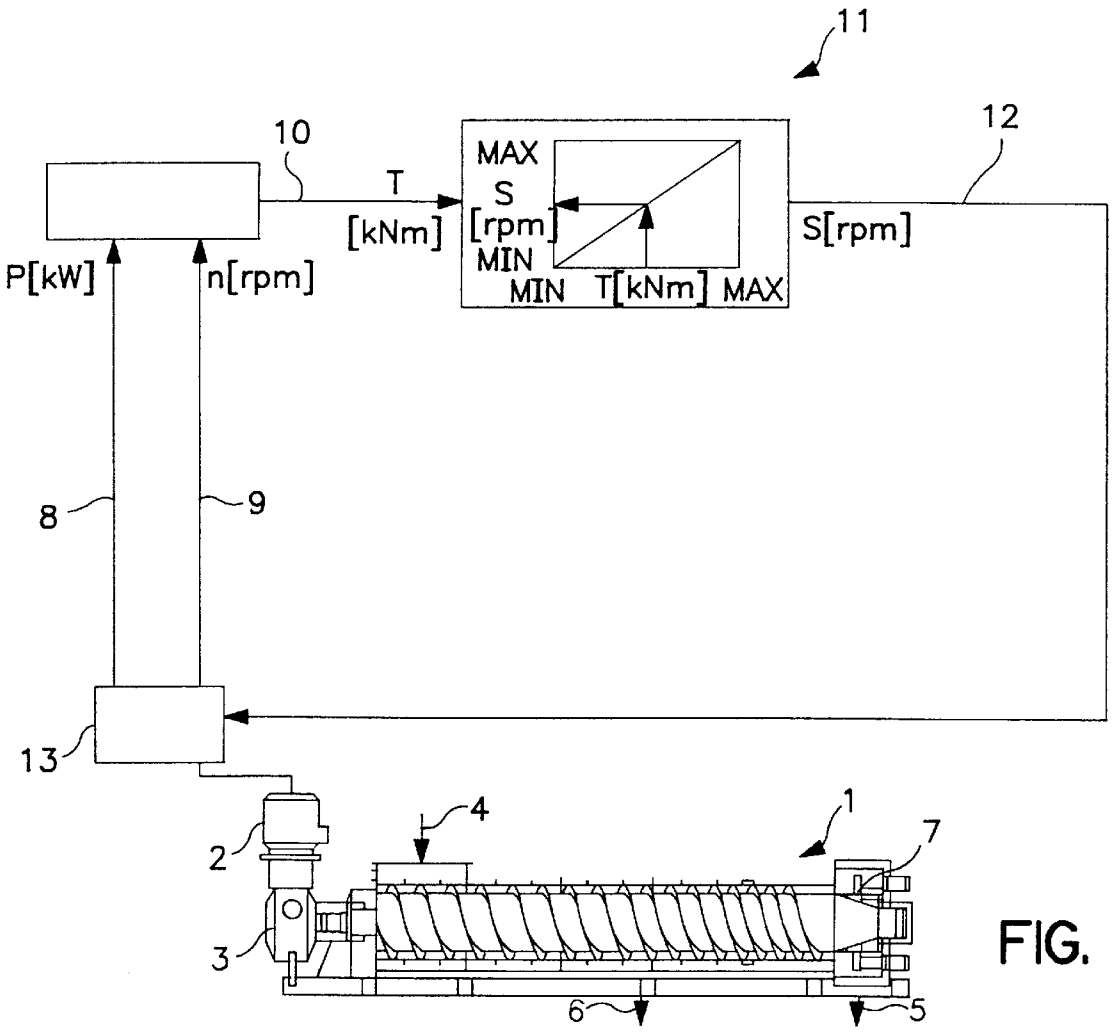
FIG. 1 is a schematic diagram of a first pulp suspension dewatering system in accordance with the invention having a drive motor controller which regulates the speed of the drive motor according to the torque of the drive motor.

FIG. 1 shows the control loop of a screw press 1 with drive motor 2 and gearbox 3. The (pulp) suspension to be dewatered is fed to the screw press through an inlet 4 and discharged again at the end of the press through an outlet 5. In addition, the filtrate 6 pressed out of the suspension is also discharged. At the end of the screw shaft, there is a counter-pressure device 7, which can be set to obtain a desired final dry content. The current power consumption 8 (P [kW]) and speed 9 (n [rpm]) determine the current torque 10 (T [kNm]). Based on this torque T, a nominal speed 12 (S [rpm]) is pre-set for the frequency controller 13 of the drive motor 2 according to a pre-defined function 11. All values in between also result from the appropriate pre-set minimum and maximum nominal speed and the minimum and maximum nominal torque. If the torque exceeds the minimum nominal torque, the speed 12 is raised from the minimum nominal speed as far as the maximum nominal speed at the maximum nominal torque, depending on the extent to which the minimum torque is exceeded. The speed range available is usually selected very generously because the pulp properties (temperature, freeness, etc.) have a great deal of influence on the speed required. As a result, the speed can fluctuate practically in a range of 1:2 at the same output and with the same screw press type 1. If the nominal speed 12 is now reduced, the filling level of the screw press 1 increases. This effects better dewatering because the pulp has more time to drain. Conversely, the filling level of the screw press 1 drops when the nominal speed 12 is reduced. The limiting values for the nominal torque are set as a function of the desired final (outlet) dry content, so that this dry content is achieved at both minimum and at maximum production. The torque required for dewatering is also strongly influenced by the pulp grade. Thus, the torque can also fluctuate in a range of 1:2 at the same output in order to obtain the same outlet dry content.

If the pulp feed and thus, the counter-pressure are altered, this effects a change in the current power consumption 8 by the motor 2, which reactivates the regulating process. A disadvantage is that the control parameters and the effects of any changes in the parameters are very difficult for the operator to understand.

Figure 2:
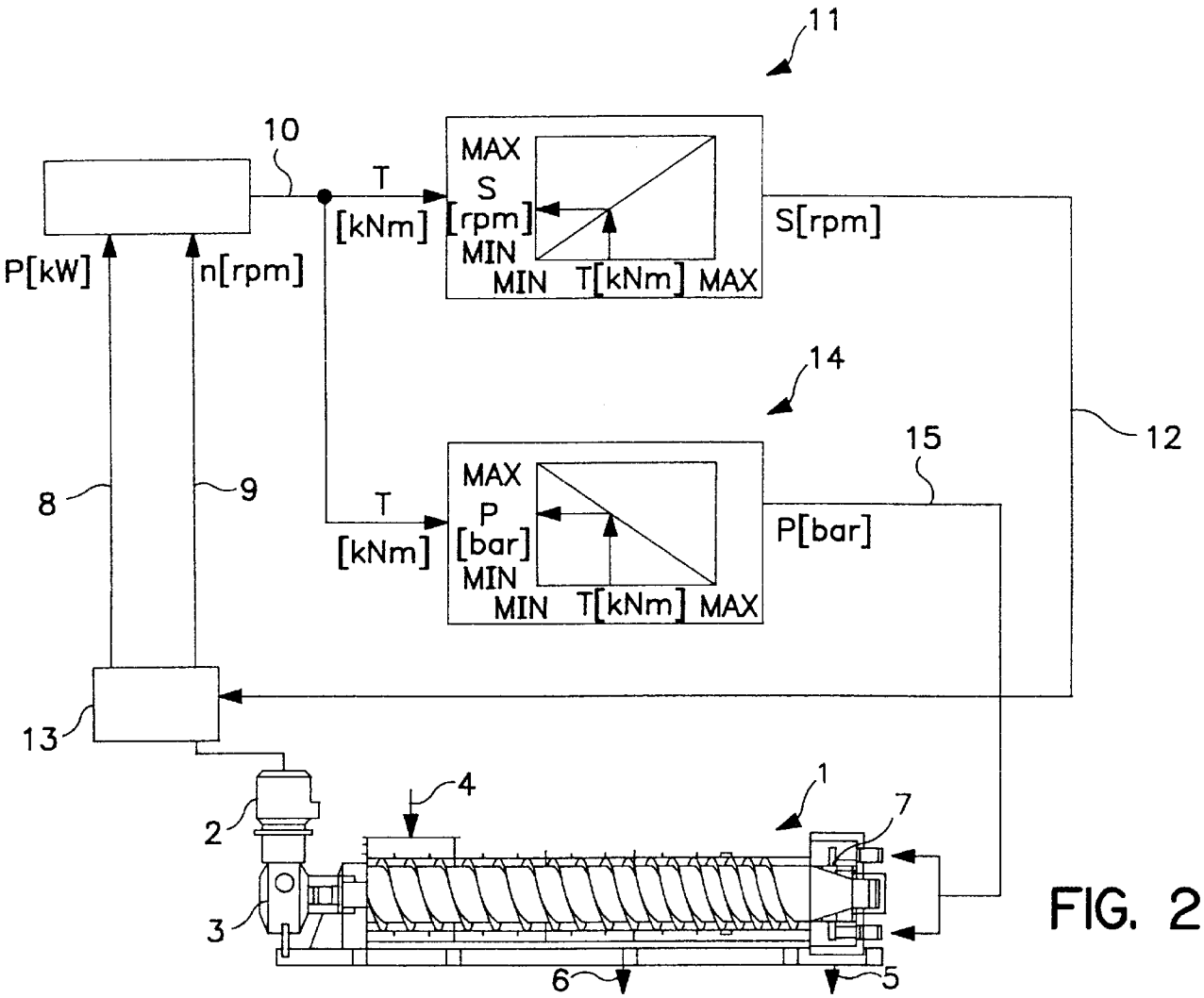
FIG. 2 is a schematic representation of a second pulp suspension dewatering system having a drive motor controller which regulates the speed of the drive motor according to the torque of the drive motor and the counter-pressure applied by a counter-pressure device.

FIG. 2 shows the additional regulating process for the counter-pressure. Based on the current torque 10, a nominal value 15 is pre-set for the counter-pressure applied by the counter-pressure device 7 in accordance with a pre-defined dependency 14. At low torque, counter-pressure is high, and at rising torque the counter-pressure is low. As a result, constant operations and a constant outlet dry content can be achieved quickly, particularly in the starting phase.

Figure 3:
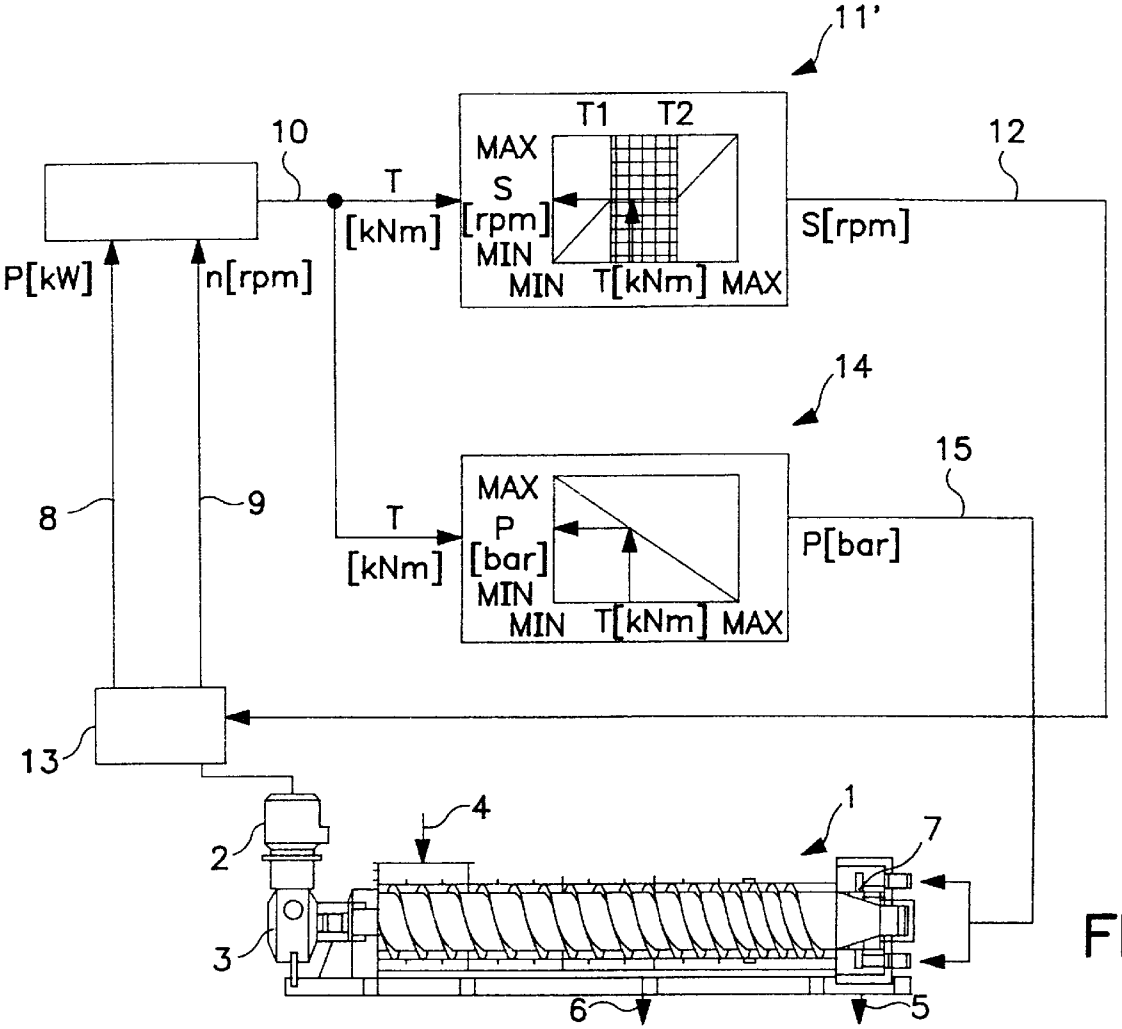
FIG. 3 is a schematic representation of a third pulp suspension dewatering system having a drive motor controller which regulates the speed of the drive motor according to the torque of the drive motor and the counter-pressure applied by a counter-pressure device, the drive motor controller providing a constant speed output over a pre-set torque range.

FIG. 3 illustrates a control process similar to FIG. 2, but where dependency 11' of the speed on the torque is different to that in FIG. 2. In a pre-set torque range between $T_1$ and $T_2$, the nominal speed S remains constant. Here, it is an advantage if the torque range is set between 5 and 20 kNm. With these torques—also know as the dead range—it is possible to prevent the speed always being re-adjusted at very low fluctuations, which would cause a system build-up.

Figure 4:
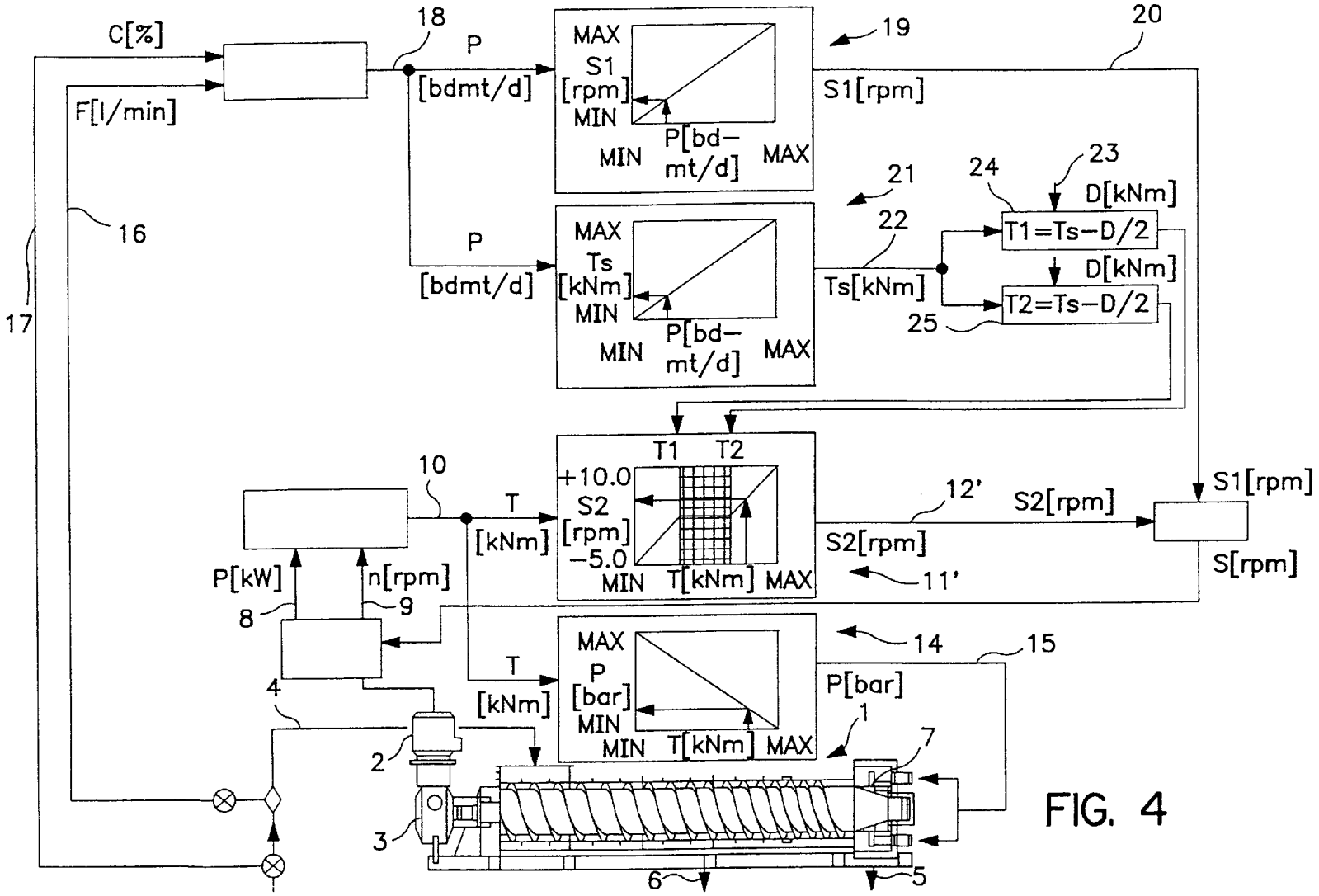
FIG. 4 is a schematic representation of a fourth pulp suspension dewatering system having a drive motor controller which regulates the speed of the drive motor according to the throughput of the system.

FIG. 4 shows an even more complex regulating process. This process, however, makes operations much simpler for the operating personnel. The output is taken as an additional parameter in determining the nominal speed S (12). In order to do this, the current throughput 16 (F [l/min]) and consistency 17 (C [%]) are measured, and the throughput 18 (P [bdmt/d]) is determined. This is then used to define a nominal value 20 for the speed $S_1$ [rpm] according to a pre-defined dependency 19. In addition, an optimum torque value 22 ($T_S$ [kNm]) is defined as a function 21 of the output. This optimum torque value 22 then determines the limiting values $T_1$ (24) and $T_2$ (25) with a pre-defined band width 23 (D [kNm]) for the so-called dead range of the dependency 11'. This dependency 11' is then used to define the range of fluctuation 12' ($S_2$ [rpm]) for the speed, where this remains constant in the dead range between $T_1$ and $T_2$. The speeds 20 ($S_1$) and 12' ($S_2$) then determine the speed 12 (S) of the frequency controller 13 for regulating the drive motor 2. The advantage of this regulating process is that the adjustable control parameters, such as minimum speed and minimum torque at minimum output, and maximum speed and maximum torque at maximum production, are easier for the operator to understand and it is also quite simple for him to modify these values. Any changes in the output cause an immediate change in speed in order to adapt the outlet dry content accordingly. There is, however, a disadvantage in that the flow rate 16 and consistency 17 measurements must be very accurate as they have direct influence on the speed.

What is claimed is:

1. Process for regulating a screw press for dewatering a pulp suspension, the screw press having a drive motor, a controller for controlling the drive motor, and a counter-pressure device, the drive motor operating over a range of torque and at a nominal speed, the process comprising the step of controlling the nominal speed of the drive motor as a function of a torque characteristic curve.

2. Process according to claim 1 wherein the nominal speed is increased when the torque rises.

3. Process according to claim 1 wherein the nominal speed is maintained at a constant level if the torque changes within a pre-set range.

4. Process according to claim 1 comprising the additional step of controlling the counter-pressure as a function of the torque, the counter-pressure being reduced if the torque is rising.

5. Process according to claim 1 wherein the ratio of the maximum torque to the minimum torque varies within the range of 1 to 6.

6. Process according to claim 1 wherein the ratio of the maximum nominal speed to the minimum nominal speed is controlled in the range of 1 to 4.

7. Process according to claim 1, the screw press further having means for measuring production of the process, the process further comprising the step of measuring the production of the process and controlling the nominal speed as a function of production.

8. Process according to claim 1 wherein the ratio of the maximum torque to the minimum torque varies within the range of 1 to 3.

9. Process according to claim 1 wherein the ratio of the maximum nominal speed to the minimum nominal speed is controlled in the range of 1 to 2.5.

10. Process for regulating a screw press for dewatering a pulp suspension, the screw press having a drive motor, a controller for controlling the drive motor, and a counter-pressure device, the drive motor operating over a range of torque and at a nominal speed, the process comprising the steps of controlling the nominal speed of the drive motor as a function of the torque characteristic curve; and controlling the counter-pressure as a function of the torque, the counter-pressure being reduced if the torque is rising.

* * * * *